US006880268B2

(12) United States Patent
Chen

(10) Patent No.: US 6,880,268 B2
(45) Date of Patent: Apr. 19, 2005

(54) SOCK COMBINED WITH INSOLE

(76) Inventor: Cheng-Ming Chen, 235 Chung-Ho Box 8-24, Taipei (TW)

( * ) Notice: Subject to any disclaimer, the term of this patent is extended or adjusted under 35 U.S.C. 154(b) by 18 days.

(21) Appl. No.: 10/437,609

(22) Filed: May 15, 2003

(65) Prior Publication Data

US 2004/0226076 A1 Nov. 18, 2004

(51) Int. Cl.[7] ..... A43B 23/07
(52) U.S. Cl. ..... 36/43; 36/10; 36/55
(58) Field of Search ..... 36/43, 44, 10, 36/55, 15, 77 R, 94, 71; 2/239, 240, 241

(56) References Cited

U.S. PATENT DOCUMENTS 2,391,064 A * 12/1945 McCandless ..... 2/239
4,078,266 A * 3/1978 Brown ..... 2/240
4,575,954 A * 3/1986 Bye ..... 36/89
4,621,648 A * 11/1986 Ivany ..... 602/27
4,645,466 A * 2/1987 Ellis ..... 441/74
4,694,590 A * 9/1987 Greenawalt ..... 36/91
4,864,741 A * 9/1989 Beauchemin ..... 36/89
4,926,568 A * 5/1990 Coffman ..... 36/15
5,092,347 A * 3/1992 Shaffer et al. ..... 128/892
5,778,565 A * 7/1998 Holt et al. ..... 36/110
5,799,414 A * 9/1998 Kellerman ..... 36/44
6,044,497 A * 4/2000 Richardson ..... 2/239
6,082,027 A * 7/2000 Wagonhurst ..... 36/97

* cited by examiner

*Primary Examiner*—Marie Patterson

(57) ABSTRACT

A sock combined with an insole comprises an insole; at least one surface of the insole is formed with elastic hooks; the hooks being deformed due to an external force, but restoring as the force disappears; and a sock having a sock body and an opening; the sock body having a sock sole; whole or part of the lower bottom of the sock sole being formed with curl wires for grasping the hooks so that the sock is tightly secured to the insole to avoid the relative motion between the sock and the insole.

7 Claims, 8 Drawing Sheets

SOCK COMBINED WITH INSOLE

FIELD OF THE INVENTION

The present invention relates to socks, and particularly to a sock combined with an insole which provides a firm structure so that the impact force does not generate a relative motion between the insole and the sock. Moreover, the front part of the foot will not impact the shoe so as to protect users.

BACKGROUND OF THE INVENTION

In the prior art, the sport shoes are larger than necessary sizes so that the users feel comfortable. Referring to FIG. 1, a cross section view shows that a sport shoe is worn, in that D is a margin for providing an adjustable space to users. However the margin D will cause that the user feel inconvenient in exercise. Another defect occurring in this prior art is that the impact of the feet will apply upon the sole of the shoe so as to hurt the feet.

SUMMARY OF THE INVENTION

Accordingly, the primary object of the present invention is to provide a sock combined with an insole which can provide a firm structure so that the impact force will not generate a relative motion between the insole and the sock. Moreover, the front part of the foot will not impact the shoe so as to protect users.

A further object of the present invention is to provide a sock combined with an insole, wherein the bottom of the sock sole has curl wire so as to fix the sock sole to the insole.

Another object of the present invention is to provide a sock combined with an insole, wherein one surface of the insole has elastic hooks for fixing the sock so as to increase the retaining ability.

To achieve above object, the present invention provides a sock combined with an insole which comprises an insole; at least one surface of the insole is formed with elastic hooks; the hooks being deformed due to an external force, but restoring as the force disappears; and a sock having a sock body and an opening; the sock body having a sock sole; whole or part of the lower bottom of the sock sole being formed with curl wires for grasping the hooks so that the sock is tightly secured to the insole to prevent the relative motion between the sock and the insole.

The various objects and advantages of the present invention will be more readily understood from the following detailed description when read in conjunction with the appended drawing.

DETAILED DESCRIPTION OF THE PREFERRED EMBODIMENT

The present invention will be described here with preferred embodiment by referencing the appended drawings.

Figure 2:
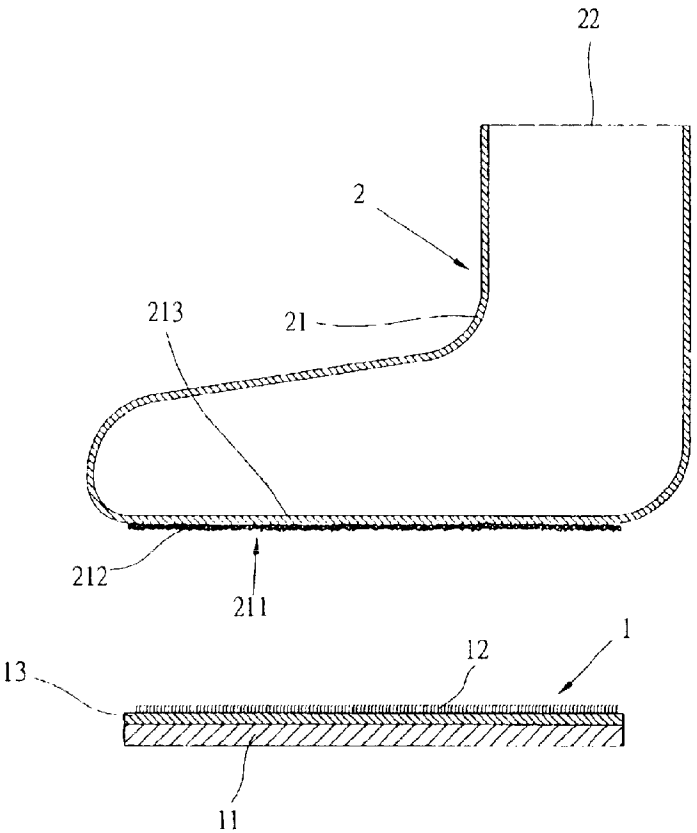
FIG. 2 is an exploded cross section view
Figure 1:
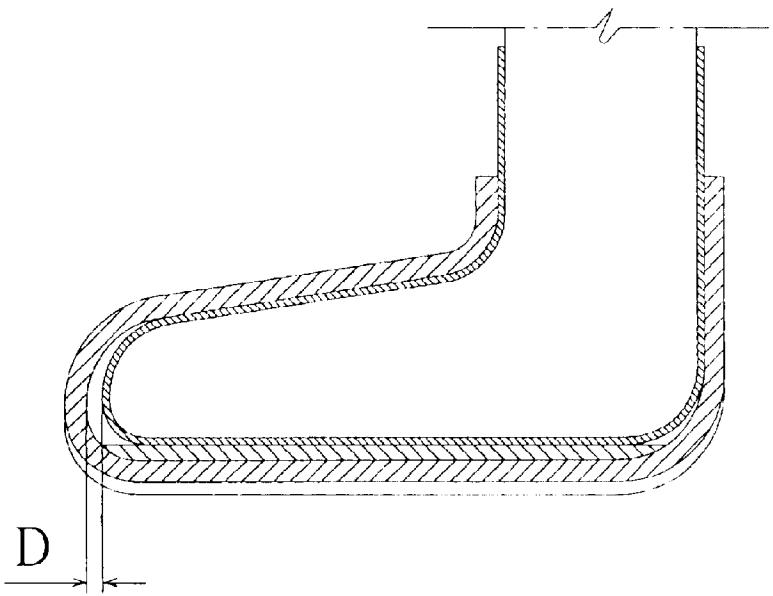
FIG.1(prior art)
FIG. 1 is a cross section view showing a prior art shoe.

Referring to FIG. 2, the sock combined with an insole of the present invention is illustrated. The present invention includes an insole 1 and a sock 2.

At least one surface of the insole 1 is installed with elastic hooks 12. The hooks 12 are deformed due to external forces, but restore as the forces disappear.

The insole 1 further includes a body 11 and at least one hook base 13. The hook 12 protrudes from the hook base 13. The body 11 is made of comfortable feeling material or ventilated and sterile material, such as foaming material.

Figure 4:
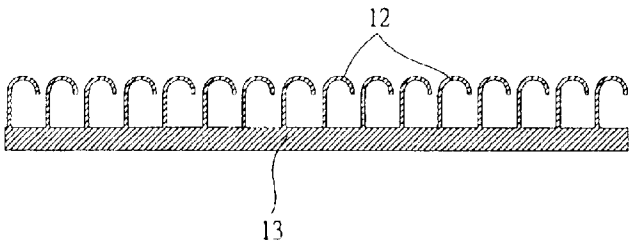
FIG. 4 is a cross section view showing one kind of the hook base and hooks of the present invention.
Figure 5:
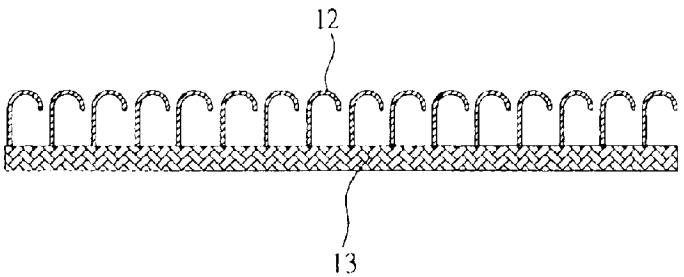
FIG. 5 is a cross section view showing another kind of the hook base and hooks of the present invention.

Moreover, the hook bases 13 and hooks 12 of the present invention can be integrally formed by plastics (referring to FIG. 4), or formed by fabrics (referring to FIG. 5).

In another embodiment, the insole 1 can be combined in the sole of a shoe so as to be a part of the shoe.

Referring to FIG. 2, the sock 2 of the present invention has a sock body 21 and an opening 22. The sock body 21 has a sock sole 211. Whole or a part of the lower bottom of the sock sole 211 is formed with curl wires 212.

Figure 6:
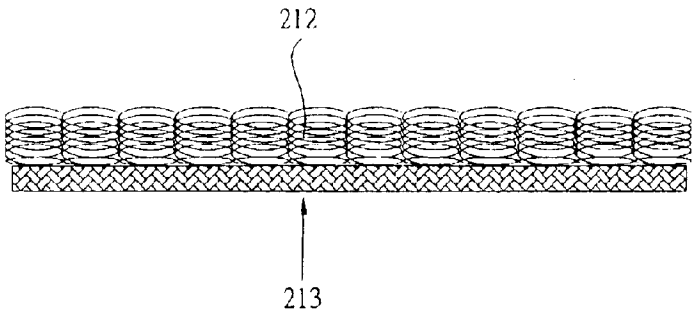
FIG. 6 is a cross section view showing the first kind of the curl wires in the present invention.
Figure 7:
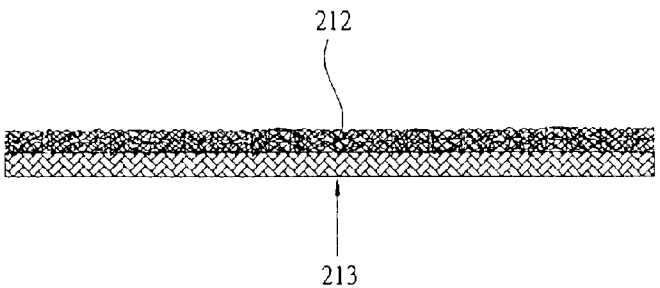
FIG. 7 is a cross section view showing the second kind of the curl wires in the present invention.

With reference to FIGS. 6 and 7, the curl wires 212 of the present invention are formed by a great number of curled wires. In general, the curled lines can be haired by a hair forming machine, or are knitted on the sock body 21.

Figure 8:
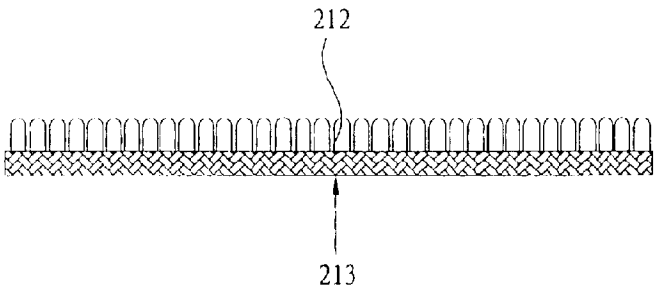
FIG. 8 is a cross section view showing the third kind of the curl wires in the present invention.

Referring to FIG. 8, the curl wires 212 of sock 2 can be closed wires knitted on the sock body 21 so as to be as a part of the sock 2.

Besides, another way for forming the curl wire 212 is to knit filaments on the sock sole and protruded from the lower surface of the sock sole. The filaments are selected from one of Polyester Fiber, Nylon, Acrylic fiber, Rayon, manmade long fibers or the combination thereof.

Figure 9:
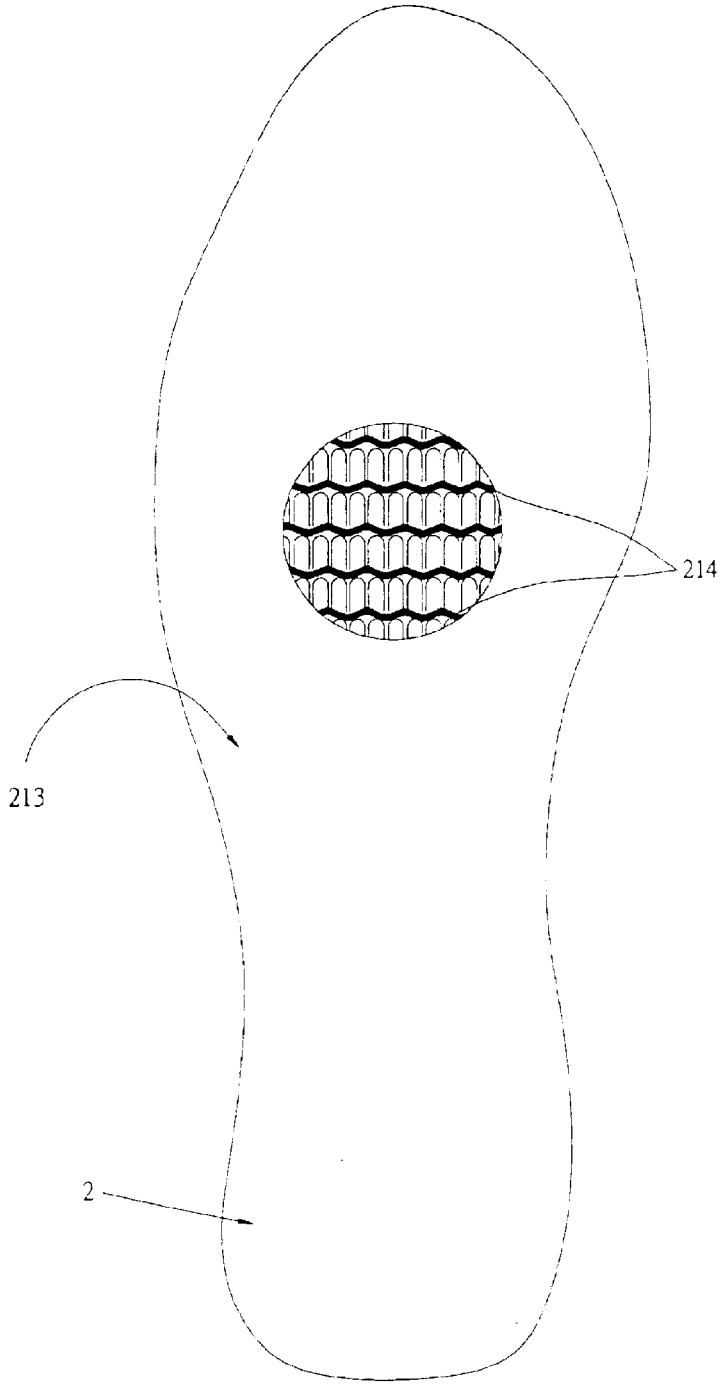
FIG. 9 is an upper view of the sock sole knitting structure where the contact surface of the sock and the foot is shown.

FIG. 9 shows one fabrics embodiment showing the upper surface 213 of a sock sole 211 of a sock 2. In this embodiment, the knitting structure has at least one kinds of skid-proof wires 214 which are formed as the upper surface 213 of the sock sole 211 of the sock 2 so that the feet and the sock sole have preferred friction force and preferred skid-proof effect.

Figure 10:
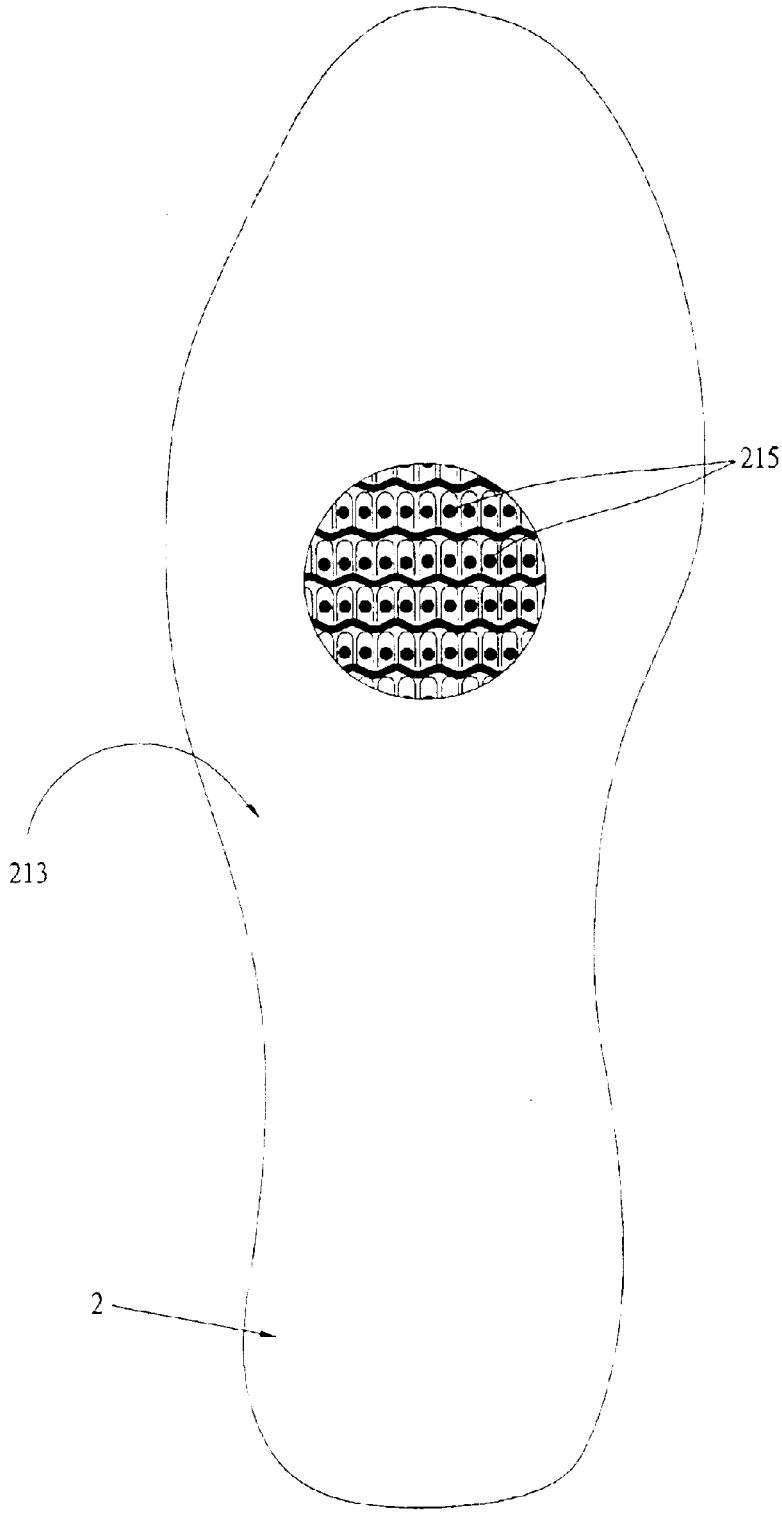
FIG. 10 is an upper view showing another sock sole knitting structure wherein the contact surface of the sock and the foot is illustrated.

FIG. 10 shows another embodiment about the upper surface 213 of the sock sole 211 of the sock 2. In this embodiment, whole or a part of the upper surface 213 of the sock sole 211 are coated with skid-proof glue 215. As above said, it has a preferred skid effect.

Figure 3:
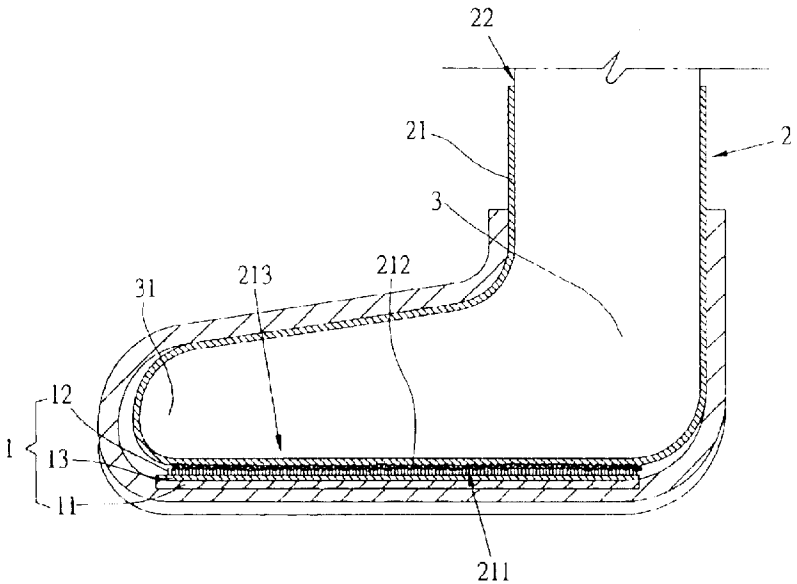
FIG. 3 is a cross section view showing the wearing state of the present invention.

With reference to FIG. 3, the curl wires 212 of the sock 2 can grasp the hooks 12 of the insole 1. In use, the sock 2 can be tightly retained on the insole 1 so as to prevent the relative motion between the sock 2 and the insole 1. In motion, the large impact generated by the foot 3 can be concentrated on a front part 31 of the foot. By the sock 2 to grasp the insole 1, the foot will not move forward so as to reduce the damage to the toes 31 and protect the foot 3, front part of the foot 3 or the toes 31.

Figure 12:
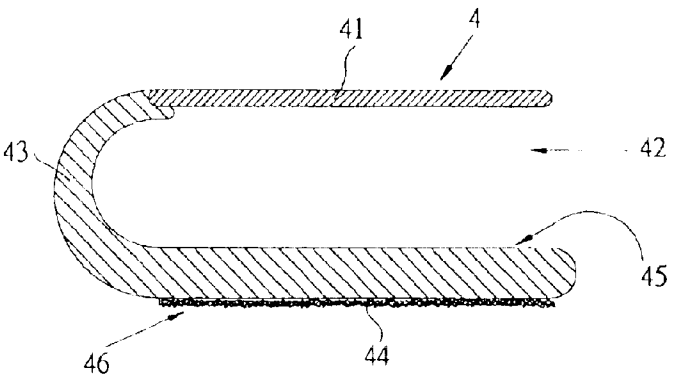
FIG. 12 is a schematic cross section view of the jacket of the present invention.
Figure 11:
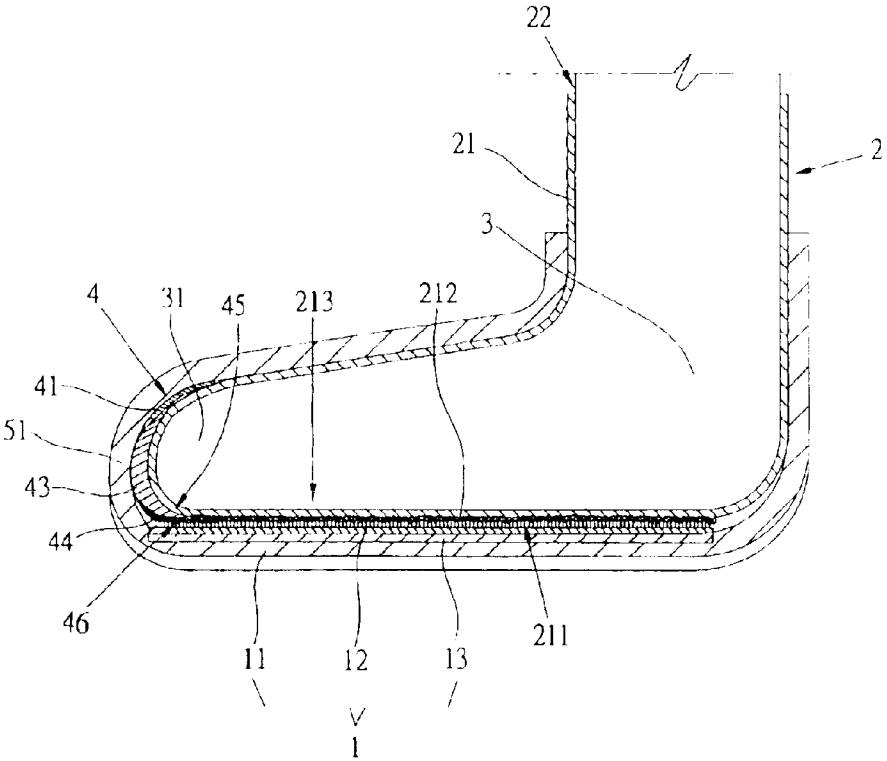
FIG. 11 is an assembled cross section view in the second embodiment of the present invention.

Referring to FIG. 11, another embodiment of the present invention is illustrated. In this embodiment, other than the insole 1 and sock 2, a jacket 4 is used. As shown in FIG. 12, the jacket 4 has a jacket body 41 and an opening 42. A thickened end portion 43 of the jacket body 41 corresponding to the opening 42 of the jacket 4 is thickened. By the opening 42, the jacket body 41 can enclose the front part or toes 31 so that the thickened end portion 43 of the jacket 4 is between the toes 31 and the front part 51 of the shoe. The thickened end portion 43 is formed as a cushion for protection the toes or the front part 31 of the foot.

Referring to FIGS. 11, 12, the jacket 4 further includes a curl wire 44 formed on a whole or a part of the lower bottom 46 of the jacket 4. Basically, the curl wire 44 is cured wires (referring to FIGS. 6, 7) or closed wires (referring to FIG. 8), or filaments of the knitting structure at the lower bottom of the jacket.

The filaments are selected from one of Polyester Fiber, Nylon, Acrylic fiber, Rayon, manmade long fibers and the combination thereof.

Figure 14:
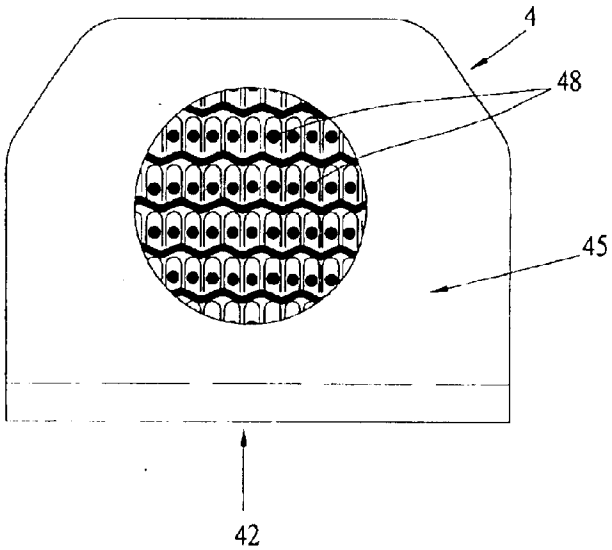
FIG. 14 is a view of the jacket of another embodiment of the present invention.
Figure 13:
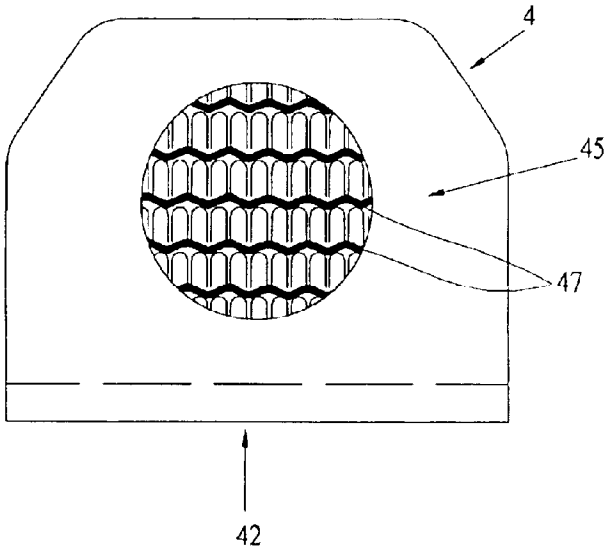
FIG. 13 is an upper view of the jacket of the present invention.

Referring to FIG. 13, besides, the knitting structure of the jacket 4 has at least one kind of skid-proof wires 47 formed on the upper surface 45 of the bottom of the jacket 4 so as to have a preferred skid-proof effect. Whole or a part of the upper bottom 45 of the jacket 4 is coated with skid-proof glue 48 so as to have a preferred skid-proof effect (referring to FIG. 14).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sock combined with an insole comprising:

an insole; at least one surface of the insole being formed with elastic hooks; the hooks being deformed due to an external force, but restoring as the force disappears; and a sock having a sock body and an opening; the sock body having a sock sole; whole or a part of the lower bottom of the sock sole being formed with curl wires for grasping the hooks so that the sock is tightly secured to the insole to avoid the relative motion between the sock and the insole;

a jacket, wherein the jacket has a jacket body and an opening; a thickened end portion of the jacket body corresponding to the opening of the jacket is thickened; by the opening, the jacket body encloses the front part of the shoe or toes of a foot so that the thickened end portion of the jacket is between the toes and the front part of the shoe; the thickened end portion is formed as a cushion for protection the toes or the front part of the foot.

2. The sock combined with an insole as claimed in claim 1, wherein the jacket further includes curl wires formed on a whole or a part of a lower bottom of the jacket.

3. The sock combined with an insole as claimed in claim 2, wherein each curl wire of the jacket is formed by a great number of curled wires.

4. The sock combined with an insole as claimed in claim 2, wherein each curl wire of jacket is closed wires.

5. The sock combined with an insole as claimed in claim 2, wherein the curl wires are selected from one of Polyester Fiber, Nylon, Acrylic fiber, Rayon, manmade long fibers or the combination thereof.

6. The sock combined with an insole as claimed in claim 1, wherein the sock has skid-proof wires knitted on an upper surface of a bottom of the sock.

7. The sock combined with an insole as claimed in claim 1, wherein whole or a part of an upper surface of a bottom of the jacket is coated with skid-proof glue.

* * * * *